US008888318B2

(12) United States Patent
Yang et al.

(10) Patent No.: US 8,888,318 B2
(45) Date of Patent: Nov. 18, 2014

(54) LED SPOTLIGHT

(75) Inventors: Haitao Yang, San Jose, CA (US); Yi-Qun Li, Danville, CA (US)

(73) Assignee: Intematix Corporation, Fremont, CA (US)

( * ) Notice: Subject to any disclaimer, the term of this patent is extended or adjusted under 35 U.S.C. 154(b) by 745 days.

(21) Appl. No.: 13/156,183

(22) Filed: Jun. 8, 2011

(65) Prior Publication Data

US 2012/0140466 A1 Jun. 7, 2012

Related U.S. Application Data

(60) Provisional application No. 61/354,049, filed on Jun. 11, 2010.

(51) Int. Cl.

| | |
|---|---|
| ***F21V 1/00*** | (2006.01) |
| ***F21K 99/00*** | (2010.01) |
| ***F21V 7/00*** | (2006.01) |
| ***F21V 7/09*** | (2006.01) |
| *F21Y 101/02* | (2006.01) |
| *F21Y 111/00* | (2006.01) |

(52) U.S. Cl.

CPC ..... *F21K 9/137* (2013.01); *F21Y 2101/02* (2013.01); *F21V 7/0008* (2013.01); *F21V 7/09* (2013.01); *F21Y 2111/007* (2013.01); *Y10S 362/80* (2013.01)

USPC ..... 362/235; 362/249.02; 362/800

(58) Field of Classification Search

CPC ..... F21K 9/137; F21V 7/09

USPC ..... 362/249.02, 235, 800

See application file for complete search history.

(56) References Cited

U.S. PATENT DOCUMENTS

| | | | |
|---|---|---|---|
| 3,290,255 | A | 12/1966 | Smith |
| 3,593,055 | A | 7/1971 | Geusic et al. |
| 3,670,193 | A | 6/1972 | Thorington et al. |

(Continued)

FOREIGN PATENT DOCUMENTS

| | | | |
|---|---|---|---|
| CN | 101182908 | A | 5/2008 |
| CN | 101614374 | A | 12/2009 |

(Continued)

OTHER PUBLICATIONS

"Fraunhofer-Gesellschafl: Research News Special1997", http://www.fhg.de/press/md-e/md1997/sondert2.hlm,(accessed on Jul. 23, 1998). Jan. 1997, Publisher: Fraunhofer Institute.

(Continued)

*Primary Examiner* — Anabel Ton

(74) *Attorney, Agent, or Firm* — Vista IP Law Group, LLP

(57) ABSTRACT

An LED spotlight that is operable to emit light with a selected emission angle measured relative to an emission axis of the spotlight comprises: a dish shaped (parabolic) reflector and a plurality of LEDs, wherein the LEDs are configured such that in operation each emits light in a generally radial direction to the emission axis of the spotlight and wherein the light emission axis of the LEDs is configured at an angle to the emission axis of the spotlight of at least 40°. In preferred embodiments the LEDs are configured such that their emission axis is substantially orthogonal to the emission axis of the spotlight and the reflector comprises a respective parabolic light reflective surface portion associated with a respective one of the LEDs.

27 Claims, 10 Drawing Sheets

(56) References Cited

U.S. PATENT DOCUMENTS

| | | | |
|---|---|---|---|
| 3,676,668 | A | 7/1972 | Collins et al. |
| 3,691,482 | A | 9/1972 | Pinnow et al. |
| 3,709,685 | A | 1/1973 | Hercock et al. |
| 3,743,833 | A | 7/1973 | Martie et al. |
| 3,763,405 | A | 10/1973 | Mitsuhata |
| 3,793,046 | A | 2/1974 | Wanmaker et al. |
| 3,819,973 | A | 6/1974 | Hosford |
| 3,819,974 | A | 6/1974 | Stevenson et al. |
| 3,849,707 | A | 11/1974 | Braslau et al. |
| 3,875,456 | A | 4/1975 | Kana et al. |
| 3,932,881 | A | 1/1976 | Mita et al. |
| 3,937,998 | A | 2/1976 | Verstegen et al. |
| 3,972,717 | A | 8/1976 | Wiedemann |
| 4,047,075 | A | 9/1977 | Schoberl |
| 4,081,764 | A | 3/1978 | Christmann et al. |
| 4,104,076 | A | 8/1978 | Pons |
| 4,143,394 | A | 3/1979 | Schoeberl |
| 4,176,294 | A | 11/1979 | Thornton, Jr. |
| 4,176,299 | A | 11/1979 | Thornton |
| 4,211,955 | A | 7/1980 | Ray |
| 4,305,019 | A | 12/1981 | Graff et al. |
| 4,315,192 | A | 2/1982 | Skwirut et al. |
| 4,443,532 | A | 4/1984 | Joy et al. |
| 4,559,470 | A | 12/1985 | Murakami et al. |
| 4,573,766 | A | 3/1986 | Bournay, Jr. et al. |
| 4,618,555 | A | 10/1986 | Suzuki et al. |
| 4,638,214 | A | 1/1987 | Beers et al. |
| 4,667,036 | A | 5/1987 | Iden et al. |
| 4,678,285 | A | 7/1987 | Ohta et al. |
| 4,727,003 | A | 2/1988 | Ohseto et al. |
| 4,772,885 | A | 9/1988 | Uehara et al. |
| 4,845,223 | A | 7/1989 | Seybold et al. |
| 4,859,539 | A | 8/1989 | Tomko et al. |
| 4,915,478 | A | 4/1990 | Lenko et al. |
| 4,918,497 | A | 4/1990 | Edmond |
| 4,946,621 | A | 8/1990 | Fouassier et al. |
| 4,992,704 | A | 2/1991 | Stinson |
| 5,077,161 | A | 12/1991 | Law |
| 5,110,931 | A | 5/1992 | Dietz et al. |
| 5,126,214 | A | 6/1992 | Tokailin et al. |
| 5,131,916 | A | 7/1992 | Eichenauer et al. |
| 5,143,433 | A | 9/1992 | Farrell |
| 5,143,438 | A | 9/1992 | Giddens et al. |
| 5,166,761 | A | 11/1992 | Olson et al. |
| 5,208,462 | A | 5/1993 | O'Connor et al. |
| 5,210,051 | A | 5/1993 | Carter, Jr. |
| 5,211,467 | A | 5/1993 | Seder |
| 5,237,182 | A | 8/1993 | Kitagawa et al. |
| 5,264,034 | A | 11/1993 | Dietz et al. |
| 5,283,425 | A | 2/1994 | Imamura |
| 5,369,289 | A | 11/1994 | Tamaki et al. |
| 5,405,709 | A | 4/1995 | Littman et al. |
| 5,439,971 | A | 8/1995 | Hyche |
| 5,518,808 | A | 5/1996 | Bruno et al. |
| 5,535,230 | A | 7/1996 | Abe |
| 5,557,168 | A | 9/1996 | Nakajima et al. |
| 5,563,621 | A | 10/1996 | Silsby |
| 5,578,839 | A | 11/1996 | Nakamura et al. |
| 5,583,349 | A | 12/1996 | Norman et al. |
| 5,585,640 | A | 12/1996 | Huston et al. |
| 5,619,356 | A | 4/1997 | Kozo et al. |
| 5,660,461 | A | 8/1997 | Ignatius et al. |
| 5,677,417 | A | 10/1997 | Muellen et al. |
| 5,679,152 | A | 10/1997 | Tischler et al. |
| 5,763,901 | A | 6/1998 | Komoto et al. |
| 5,770,887 | A | 6/1998 | Tadatomo et al. |
| 5,771,039 | A | 6/1998 | Ditzik |
| 5,777,350 | A | 7/1998 | Nakamura et al. |
| 5,869,199 | A | 2/1999 | Kido |
| 5,897,196 | A | 4/1999 | Soskind et al. |
| 5,959,316 | A | 9/1999 | Lowery |
| 5,962,971 | A | 10/1999 | Chen |
| 5,998,925 | A | 12/1999 | Shimizu |
| 6,102,555 | A | 8/2000 | Mizoguchi |
| 6,137,217 | A | 10/2000 | Pappalardo et al. |
| 6,340,824 | B1 | 1/2002 | Komoto et al. |
| 6,350,041 | B1 | 2/2002 | Tarsa |
| 6,504,301 | B1 | 1/2003 | Lowery |
| 6,576,488 | B2 | 6/2003 | Collins et al. |
| 6,600,175 | B1 | 7/2003 | Baretz et al. |
| 6,642,618 | B2 | 11/2003 | Yagi et al. |
| 6,642,652 | B2 | 11/2003 | Collins et al. |
| 6,869,812 | B1 | 3/2005 | Liu |
| 7,048,412 | B2 * | 5/2006 | Martin et al. ..... 362/247 |
| 7,153,015 | B2 | 12/2006 | Brukilacchio |
| 7,311,858 | B2 | 12/2007 | Wang |
| 7,390,437 | B2 | 6/2008 | Dong |
| 7,479,662 | B2 | 1/2009 | Soules et al. |
| 7,541,728 | B2 | 6/2009 | Wang |
| 7,575,697 | B2 | 8/2009 | Li |
| 7,601,276 | B2 | 10/2009 | Li |
| 7,615,795 | B2 | 11/2009 | Baretz et al. |
| 7,628,513 | B2 | 12/2009 | Chiu |
| 7,648,650 | B2 | 1/2010 | Liu |
| 7,655,156 | B2 | 2/2010 | Cheng |
| 7,806,558 | B2 * | 10/2010 | Williamson ..... 362/241 |
| 7,824,076 | B2 * | 11/2010 | Koester ..... 362/294 |
| 7,943,945 | B2 | 5/2011 | Baretz et al. |
| 8,100,557 | B2 * | 1/2012 | Chen et al. ..... 362/249.02 |
| 8,616,724 | B2 * | 12/2013 | Pickard et al. ..... 362/241 |
| 2003/0227774 | A1 * | 12/2003 | Martin et al. ..... 362/240 |
| 2004/0016938 | A1 | 1/2004 | Baretz et al. |
| 2006/0049416 | A1 | 3/2006 | Baretz et al. |
| 2008/0224597 | A1 | 9/2008 | Baretz et al. |
| 2008/0224598 | A1 | 9/2008 | Baretz et al. |
| 2009/0002997 | A1 | 1/2009 | Koester |
| 2009/0323336 | A1 * | 12/2009 | Kuo et al. ..... 362/247 |
| 2010/0142208 | A1 | 6/2010 | Kokado et al. |
| 2010/0182784 | A1 | 7/2010 | Foo |
| 2010/0237760 | A1 | 9/2010 | Yang |
| 2010/0308712 | A1 | 12/2010 | Liu et al. |
| 2011/0310608 | A1 * | 12/2011 | Lapatovich et al. ..... 362/249.02 |
| 2012/0120649 | A1 * | 5/2012 | Catalano et al. ..... 362/231 |

FOREIGN PATENT DOCUMENTS

| | | | |
|---|---|---|---|
| CN | 201368347 | Y | 12/2009 |
| CN | 101655187 | A | 2/2010 |
| EP | 647694 | | 4/1995 |
| GB | 2 017 409 | | 10/1979 |
| JP | S50-79379 | | 11/1973 |
| JP | 60170194 | | 9/1985 |
| JP | 862-189770 | | 8/1987 |
| JP | H01-1794 71 | | 7/1989 |
| JP | 01-260707 | | 10/1989 |
| JP | H02-91980 | | 3/1990 |
| JP | H3-24692 | | 3/1991 |
| JP | 4010665 | | 1/1992 |
| JP | 4010666 | | 1/1992 |
| JP | 04-289691 | | 10/1992 |
| JP | 4-321280 | | 11/1992 |
| JP | 05-152609 | | 6/1993 |
| JP | 6207170 | | 7/1994 |
| JP | 6-267301 | | 9/1994 |
| JP | 6283755 | | 10/1994 |
| JP | 07-099345 | | 4/1995 |
| JP | H07-176794 | | 7/1995 |
| JP | 07-235207 | | 9/1995 |
| JP | H7-282609 | | 10/1995 |
| JP | H08-7614 | | 1/1996 |
| JP | 8-250281 | | 9/1996 |
| JP | 3048632 | U | 5/1998 |
| JP | 2900928 | | 3/1999 |
| JP | P2003-234513 | | 8/2003 |
| JP | P3724490 | | 9/2005 |
| JP | P3724498 | | 9/2005 |
| WO | WO 9108508 | | 6/1991 |
| WO | WO 2009/063655 | A1 | 5/2009 |
| WO | WO 2010/028861 | A1 | 3/2010 |

OTHER PUBLICATIONS

Adachi, C. et al., "Blue light-emitting organic electroluminescent devices", "Appl. Phys. Lett.", Feb. 26, 1990, pp. 799-801, vol. 56, No. 9.

(56) References Cited

OTHER PUBLICATIONS

Akasaki, Isamu, et al., "Photoluminescence of Mg-doped p-type GaN and electroluminescence of GaN p-n junction LED", "Journal of Luminescence", Jan.-Feb. 1991, pp. 666-670, vol. 48-49 pt. 2.
Apr. 14, 2010 Office Action in U.S. Appl. No. 11/264,124.
Apr. 15, 2009 Office Action in U.S. Appl. No. 11/264,124.
Armaroli, N. et al., "Supramolecular Photochemistry and Photophysics.", "J. Am. Chern. Soc.", 1994, pp. 5211-5217, vol. 116.
Aug. 21, 2006 Office Action in U.S. Appl. No. 10/623,198.
Aug. 24, 2007 Office Action in U.S. Appl. No. 11/264,124.
Aug. 26, 2010 Office Action in U.S. Appl. No. 12/131,118.
Berggren, M. et al., "Light-emitting diodes with variable colours from polymer blends", "Nature", Dec. 1, 1994, pp. 444-446, vol. 372.
Berggren, M., et al., "White light from an electroluminescent diode made from poly[3(4-octylphenyl)-2,2'-bithiophene] and an oxadiazole . . . ", "Journal of Applied Physics", Dec. 1994, pp. 7530-7534, vol. 76, No. 11.
Boonkosum, W. et al., "Novel Flat Panel display made of amorphous SiN:H/SiC:H thin film LED", "Physical Concepts and Materials for Novel Optoelectronic Device Applications II", 1993, pp. 40-51, vol. 1985.
Bradfield, P.L., et al., "Electroluminescence from sulfur impurities in a p-n junction formed in epitaxial silicon", "Appl. Phys. Lett", 07110/1989, pp. 10D-102, vol. 55, No. 2.
Chao, Zhang Jin, et al., "White light emitting glasses", "Journal of Solid State Chemistry", 1991, pp. 17-29, vol. 93.
Comrie, M. , "Full Color LED Added to Lumex's Lineup", "EBN", Jun. 19, 1995, p. 28.
CRC Handbook, 63rd Ed., (1983) p. E-201.
Das, N.C., et al., "Luminescence spectra of ann-channel metal-oxide-semiconductor field-effect transistor at breakdown", 1990, pp. 1152-1153, vol. 56, No. 12.
Dec. 16, 2004 Office Action in U.S. Appl. No. 10/623,198.
Dictionary Definition of Phosphor, Oxford English Dictionary Online, Mar. 9, 2012 (Only partial available due to corrupt file, on Mar. 22, 2012 in U.S. Appl. No. 12/131,119; Request for Full Reference filed).
El Jouhari, N., et al., "White light generation using fluorescent glasses activated by Ce3+, Tb3+ and Mn2+ ions", "Journal De Physique IV, Colloque C2", Oct. 1992, pp. 257-260, vol. 2.
Feb. 21, 2012 Office Action in U.S. Appl. No. 12/131,118.
Feb. 26, 2008 Office Action in U.S. Appl. No. 11/264,124.
Feb. 4, 2005 Office Action in U.S. Appl. No. 10/623,198.
Feb. 7, 2007 Office Action in U.S. Appl. No. 11/264,124.
Forrest, S. et al. , "Organic emitters promise a new generation of displays", "Laser Focus World", Feb. 1995, pp. 99-107.
Hamada, Y. et al. , "Blue-Light-Emitting Organic Electroluminescent Devices with Oxadiazole Dimer Dyes as an Emitter", "Jpn. J. Appl. Physics", Jun. 1992, pp. 1812-1816, vol. 31.
Hamakawa, Yoshihiro, et al., "Toward a visible light display by amorphous SiC:H alloy system", "Optoelectronics—Devices and Technologies", Dec. 1989, pp. 281-294, vol. 4, No. 2.
Hirano, Masao, et al., "Various performances of fiber-optical temperature sensor utilizing infrared-to-visible conversion phosphor", "Electrochemisty (JP)", Feb. 1987, pp. 158-164, vol. 55, No. 2, Publisher: Electrochemical Society of Japan.
Jang, S., "Effect of Avalanche-Induced Light Emission on the Multiplication Factor in Bipolar Junction Transistors", "Solid-State Electronics", 1991, pp. 1191-1196, vol. 34, No. 11.
Jan. 29, 2007 Office Action in U.S. Appl. No. 10/623,198.
Jan. 30, 2006 Office Action in U.S. Appl. No. 11/264,124.
Jan. 7, 2011 Office Action in U.S. Appl. No. 12/131,119.
Jul. 10, 2008 Office Action in U.S. Appl. No. 11/264,124.
Jul. 14, 2005 Notice of Allowance, Notice of Allowability, and Examiner's Statement of Reasons for Allowance in U.S. Appl. No. 10/623,198.
Jul. 14, 2011 Office Action in U.S. Appl. No. 12/131,119.
Jul. 7, 2011 Office Action in U.S. Appl. No. 12/131,118.
Jun. 14, 2006 Office Action in U.S. Appl. No. 11/264,124.
Jun. 26, 2007 Office Action in U.S. Appl. No. 10/623,198.
Kido, J. et al. , "1,2,4-Triazole Derivative as an Electron Transport Layer in Organic Luminescent Devices", "Jpn. J. Appl. Phys.", Jul. 1, 1993, pp. L917-L920, vol. 32.
Kido, J. et al. , "Bright blue electroluminescence from poly(N-vinylcarbazole)", "Appl. Phys. Letters", Nov. 8, 1993, pp. 2627-2629, vol. 63, No. 19.
Kido, J., et al., "White light-emitting organic electroluminescent devices using the poly(N-vinylcarbazole) emitter layer doped with . . . ", "Appl. Phys. Lett.", Feb. 14, 1994, pp. 815-817, vol. 64, No. 7.
Krames, M., et al., "Status and Future of High-Power Light-Emitting Diodes for Solid-Slate Lighting", "Journal of Display Technology", Jun. 2007, pp. 160-175, vol. 3, No. 2.
Kudryashov, V., et al., "Spectra of Superbright Blue and Green InGaN/AlGaN/GaN Light-Emitting diodes", "Journal of the European Ceramic Society", May 1996, pp. 2033-2037, vol. 17.
Larach, S., et al., "Blue emitting luminescent phosphors: Review and status", "Int'l Workshop on Electroluminescence", 1990, pp. 137-143.
LEDs and Laser Diodes, Electus Distribution, copyright 2001, available at URL:http://www.jaycar.com.au/images_uploaded/ledlaser.Pdf.
Lester, S., et al., "High dislocation densities in high efficiency GaN-based light-emitting diodes", "Appl. Phys. Lett.", Mar. 6, 1995, pp. 1249-1251, vol. 66, No. 10.
Lumogen® F Violet 570 Data Sheet; available at the BASF Chemical Company website Lumogen® F Violet 570 Data Sheet; available at the BASF Chemical Company website URL,http://worldaccount.basf.com/wa/EUen_GB/Catalog/Pigments/doc4/BASF/PRD/30048274/.pdf?title=Technicai%20Datasheet&asset_type=pds/pdf&language=EN&um=um:documentum:eCommerce_soi_EU :09007bb280021e27.pdf:09007bb280021e27.pdf.
Mar. 2, 2009 Office Action in U.S. Appl. No. 10/623,198.
Mar. 22, 2012 Office Action in U.S. Appl. No. 12/131,119.
Mar. 28, 2006 Office Action in U.S. Appl. No. 10/623,198.
Mar. 4, 2011 Notice of Allowance, Notice of Allowability, Examiner's Interview Summary, Examiner's Amendment/ Comment and Examiner's Statement of Reason for Allowance in U.S. Appl. No. 11/264,124.
Mar. 7, 2008 Office Action in U.S. Appl. No. 10/623,198.
Maruska, H.P., "Gallium nitride light-emitting diodes (dissertation)", "Dissertation Submitted to Stanford University", Nov. 1973.
Maruska, H.P., et al., "Violet luminescence of Mg-doped GaN", "Appl. Phys. Lett.", Mar. 15, 1973, pp. 303-305, vol. 22, No. 6.
May 4, 2010 Office Action in U.S. Appl. No. 12/131,119.
McGraw-Hill, "McGraw-Hill Dictionary of Scientific and Technical Terms, Third Edition", "McGraw-Hill Dictionary of Scientific and Technical Terms", 1984, pp. 912 and 1446, Publisher: McGraw-Hill.
McGraw-Hill, "McGraw-Hill Encyclopedia of Science and Technology, Sixth Edition", "McGraw-Hill Encyclopedia of Science and Technology", 1987, pp. 582 and 60-63, vol. 9-10, Publisher: McGraw-Hill.
Mimura, Hidenori, et al., "Visible electroluminescence from uc-SiC/porous Si/c-Si p-n junctions", "Int. J. Optoelectron.", 1994, pp. 211-215, vol. 9, No. 2.
Miura, Noboru, et al., "Several Blue-Emitting Thin-Film Electroluminescent Devices", "Jpn. J. Appl. Phys.", Jan. 15, 1992, pp. L46-L48, vol. 31, No. Part 2, No. 1A IB.
Morkoc et al., "Large-band-gap SIC, 111-V nitride, and II-VI ZnSe-based semiconductor device technologies", J. Appl. Phys. 76(3), 1; Mar. 17, 1994; Illinois University.
Muench, W.V., et al., "Silicon carbide light-emitting diodes with epitaxial junctions", "Solid-State Electronics", Oct. 1976, pp. 871-874, vol. 19, No. 10.
Mukai, T., et al., "Recent progress of nitride-based light emitting devices", "Phys. Stat. Sol.", Sep. 2003, pp. 52-57, vol. 200, No. 1.
Nakamura, S., et al., "High-power InGaN single-quantum-well-structure blue and violet light-emitting diodes", "Appl. Phys. Lett.", Sep. 25, 1995, pp. 1868-1870, vol. 67, No. 13.
Nakamura, S., et al., "The Blue Laser Diode: GaN Based Light Emitters and Lasers", Mar. 21, 1997, p. 239, Publisher: Springer-Verlag.

(56) References Cited

OTHER PUBLICATIONS

Nakamura, S., et al., "The Blue Laser Diode: The Complete Story, 2nd Revised and Enlarged Edition", Oct. 2000, pp. 237-240, Publisher: Springer-Verlag.
Nov. 30, 2010 Office Action in U.S. Appl. No. 12/131,118.
Oct. 20, 2008 Office Action in U.S. Appl. No. 10/623,198.
Pankove, J.I., et al., "Scanning electron microscopy studies of GaN", "Journal of Applied Physics", Apr. 1975, pp. 1647-1652, vol. 46, No. 4.
Pavan, P., et al., "Explanation of Current Crowding Phenomena Induced by Impact Ionization in Advanced Si Bipolar Transistors by Means of . . . ", "Microelectronic Engineering", 1992, pp. 699-702, vol. 19.
Pei, Q, et al., "Polymer Light-Emitting Electrochemical Cells", "Science", Aug. 25, 1995, pp. 1086-1088, vol. 269, No. 5227.
Reexam Advisory Action dated Sep. 28, 2012 for U.S. Appl. No. 90/010,940.
Reexam Final Office Action dated May 24, 2012 for U.S. Appl. No. 90/010,940.
Reexam Final Office Action dated Nov. 7, 2011 for U.S. Appl. No. 90/010,940.
Reexam Non-Final Office Action dated Jan. 26, 2012 for U.S. Appl. No. 90/010,940.
Reexam Non-Final Office Action dated Mar. 3, 2011 for U.S. Appl. No. 90/010,940.
Reexam Non-Final Office Acton dated Sep. 20, 2010 for U.S. Appl. No. 90/010,940.
Roman. D., "LEDs Turn A Brighter Blue", "Electronic Buyers' News", Jun. 19, 1995, pp. 28 and 35, vol. 960, Publisher: CMP Media LLC.
Saleh and Teich, Fundamentals of Photonics, New York: John Wiley & Sons, 1991, pp. 592-594.
Sato, Yuichi, et al., "Full-color fluorescent display devices using a near-UV light-emitting diode", "Japanese Journal of Applied Physics", Jul. 1996, pp. L838-L839, vol. 35, No. ?A.
Sep. 17, 2009 Notice of Allowance, Notice of Allowability, Examiner's Amendmeni/Comment, and Examiner's Statement of Reasons for Allowance in U.S. Appl. No. 10/623,198.
Sep. 29, 2009 Office Action in U.S. Appl. No. 11/264,124.
Tanaka, Shosaku, et al., "Bright white-light electroluminescence based on nonradiative energy transfer in Ce- and Eu-doped SrS thin films", "Applied Physics Letters", Nov. 23, 1987, pp. 1661-1663, vol. 51, No. 21.
Tanaka, Shosaku, et al., "White Light Emitting Thin-Film Electroluminescent Devices with SrS:Ce,Cl/ZnS:Mn Double Phosphor Layers", "Jpn. J. Appl. Phys.", Mar. 20, 1986, pp. L225-L227, vol. 25, No. 3.
The Penguin Dictionary of Electronics, 3rd edition, pp. 315,437-438, 509-510, copyright 1979, 1988, and 1998.
Ura, M. , "Recent trends of development of silicon monocarbide blue-light emission diodes", "Kinzoku", 1989, pp. 11-15, vol. 59, No. 9.
Werner, K. , "Higher Visibility for LEDs", "IEEE Spectrum", Jul. 1994, pp. 30-39.
Wojciechowski, J. et al. , "Infrared-to-Blue Up-Converting Phosphor", "Electron Technology", 1978, pp. 31-47, vol. 11, No. 3.
Yamaguchi, Y. et al., "High-Brightness SiC Blue LEDS and Their Application to Full Color LED Lamps", "Optoelectronics—Devices and Technologies", Jun. 1992, pp. 57-67, vol. 7, No. 1.
Yang. Y., et al., "Voltage controlled two color light-emitting electrochemical cells", "Appl. Phys. Lett.", 1996, vol. 68, No. 19.
Yoshimi, Masashi, et al., "Amorphous carbon basis blue light electroluminescent device", "Optoelectronics—Devices and Technologies", Jun. 1992, pp. 69-81, vol. 7, No. 1.
Zanoni, E., et al., "Impact ionization, recombination, and visible light emission in ALGaAs/GaAs high electron mobility transistors", "J. Appl. Phys.", 1991, pp. 529-531, vol. 70, No. 1.
Zanoni, E., et al., "Measurements of Avalanche Effects and Light Emission in Advanced Si and SiGe Bipolar Transistors", "Microelectronic Engineering", 1991, pp. 23-26, vol. 15.
Zdanowski, Marek, "Pulse operating up-converting phosphor LED", "Electron Technol.", 1978, pp. 49-61, vol. 11, No. 3.
Zhiming, Chen, et al., "Amorphous thin film white-LED and its light-emitting mechanism", "Conference Record of the 1991 International Display Research Conference", Oct. 1991, pp. 122-125.
The International Search Report and The Written Opinion for PCT/US2011/039864 dated Oct. 7, 2011, 3 pages.
Chinese Office Action dated Dec. 19, 2013 for Chinese Patent Application No. 201180034986.9.
Amano, H., et al., "UV and blue electroluminescence from AI/GaN;Mg/GaN LED treated with low-energy electron beam irradiation (LEEBI)", "Institute of Physics: Conference Series", 1990, pp. 725-730, vol. 106, No. 10.
Supplementary European Search Report dated Mar. 21, 2014 for EP Appln. No. 11793196.4.

* cited by examiner

LED SPOTLIGHT

CLAIM OF PRIORITY

This application claims the benefit of priority to U.S. Provisional Patent application 61/354,049, filed Jun. 11, 2010, entitled "LED Spotlight", by Yang et al., the specification and drawings of which are incorporated herein by reference.

BACKGROUND OF THE INVENTION

1. Field of the Invention

This invention relates to LED-based (Light Emitting Diode-based) spotlights and in particular, although not exclusively, to a spotlight with an emission angle of 20° or less.

2. Description of the Related Art

White light emitting LEDs ("white LEDs") are known in the art and are a relatively recent innovation. It was not until LEDs emitting in the blue/ultraviolet part of the electromagnetic spectrum were developed that it became practical to develop white light sources based on LEDs. As taught, for example in U.S. Pat. No. 5,998,925, white LEDs include one or more phosphor materials, that is photo-luminescent materials, which absorb a portion of the radiation emitted by the LED and re-emit radiation of a different color (wavelength). Typically, the LED chip generates blue light and the phosphor material(s) absorbs a percentage of the blue light and re-emits yellow light or a combination of green and red light, green and yellow light or yellow and red light. The portion of the blue light generated by the LED that is not absorbed by the phosphor material combined with the light emitted by the phosphor material provides light which appears to the human eye as being nearly white in color.

Currently there is a lot of interest in using high brightness white LEDs to replace conventional incandescent light bulbs, halogen reflector lamps and fluorescent lamps. Most lighting devices utilizing high brightness white LEDs comprise arrangements in which a plurality of LEDs replaces the conventional light source component and utilize the existing optical components such as a reflector and/or a lens. Ideally a spotlight would generate an illuminance (luminous flux (power) per unit area incident on a surface) that was substantially uniform across the lamp's emission angle (beam spread). However, as light emission from a lamp is confined within a selected emission angle this can result in a greater proportion of the light emission being concentrated on the axis thereby further reducing illuminance uniformity within the emission angle. Unlike a filament lamp which closely approximates to a point source, LED based lamps generate light which is often far from point source in character requiring the development of new optical arrangements for LED lamps for general lighting applications. A need exists for an LED based spotlight with a selected emission angle of 20° or less.

Co-pending U.S. patent application Ser. No. 12/721,311 filed Mar. 10, 2010 (Publication No. US2010/0237760), by Haitao YANG, teaches an LED-based downlight comprising a thermally conductive body; a plurality of light emitting diodes (LEDs) configured as an array and mounted in thermal communication with the body; and a light reflective hood located in front of the plane of LEDs. The hood has at least two frustoconical (i.e. a cone whose apex is truncated by a plane that is parallel to the base) light reflective surfaces that surround the array of LEDs and are configured such that in operation light emitted by the lamp is within a selected emission angle. Whilst such a configuration can produce a good uniform illumination for emission angles of 40° and greater such a configuration is unsuitable for spotlights with lower emission angles and in particular spotlights with a compact form factor.

Chinese Patent No. CN 201368347Y, to Mass Technology Co Ltd (HK), teach an LED reflector lamp comprising at least two LED light sources mounted on a respective light source panel which in turn are mounted in thermal contact to opposite faces of at least one heat conducting plate. A reflector cup having a slot in the bottom enables the LED light source panels and heat conducting plate to be inserted into the bottom of the reflector cup such that the LED sources are parallel with the central vertical axis of the reflector cup.

SUMMARY OF THE INVENTION

According to the invention an LED spotlight that is operable to generate light with a selected emission angle measured relative to an emission axis of the spotlight comprises: a dish-shaped reflector and a plurality of LEDs, wherein the LEDs are configured such that in operation each emits light in a generally radial direction to the emission axis of the spotlight and wherein the light emission axis of each LED is configured at an angle to the emission axis of the spotlight of at least 40°. The LEDs can be configured such that their emission axis is at an acute angle to the emission axis of the spotlight at an angle in a range 40° to 85°. Alternatively the LEDs can be configured such that their emission axis is at an obtuse angle to the emission axis of the spotlight at an angle in a range 95° to 140°. Configuring the emission axis of the LEDs in such a manner enables a spotlight to be fabricated that has a compact form factor and a narrow emission angle.

In one arrangement the LEDs are configured such that their emission axis is substantially orthogonal to the emission axis of the spotlight. Preferably the LEDs are configured as at least one linear array that lies on a line that is mutually orthogonal to the emission axis of the LEDs and the emission axis of the spotlight. Advantageously the reflector comprises a respective generally parabolic light reflective surface associated with LED (elliptical parabaloidal quadratic surface as defined by rotation of an ellipse). The reflective surface can comprise a continuous smooth surface or a multifaceted surface.

In preferred implementations the spotlight further comprises a thermally conductive substrate on which the LEDs are mounted in thermal communication. In one arrangement the substrate is substantially planar and the LEDs are mounted to opposite faces of the substrate. Preferably the LEDs are configured as a respective linear array on opposite faces of the substrate and the reflector comprises a respective parabolic light reflective surface portion associated with each LED. For example in one implementation in which the substrate is planar, four LEDs are configured as a respective linear array on opposite faces of the substrate and the reflector comprises four parabolic light reflective quadrants.

Alternatively, the substrate can be polygonal in form and the LEDs mounted to respective faces of the substrate. Preferred substrate geometries can include triangular, square, rectangular, pentagonal and hexagonal. To further aid in the dissipation of heat generated by the LEDs the substrate can further comprise rib portions that extend in a radial direction from one or more corners of the substrate and/or extend from the faces of the substrate between LEDs The thermally conductive substrate can comprise a metal core printed circuit board (MCPCB). To aid in the dissipation of heat generated by the LEDs the substrate has as high a thermal conductivity as possible and is preferably at least 150 $Wm^{-1}K^{-1}$ and advantageously at least 200 $Wm^{-1}K^{-1}$. The substrate can comprise aluminum, an alloy of aluminum, a magnesium alloy, copper, a thermally conductive ceramic material. As well as thermally conductive substrates that dissipate heat passively by a process of heat conduction and convection the substrate can also comprise active cooling such as micro heat loops or a thermoelectric cooling element.

Typically the spotlight is configured such that the emission angle is 20° or lower and preferably less than about 10°.

The spotlight can further comprise a light diverging light transmissive cover positioned over the reflector opening. Such a cover enables the emission angle of the spotlight to be modified by changing the cover.

The spotlight can further comprise a thermally conductive body and wherein the substrate is in thermal communication with the body. The form of the body is preferably generally cylindrical, generally conical or generally hemispherical in form. Advantageously the body is configured such that the spotlight can be fitted directly in an existing lighting fixture and is preferably configured such that it has a form factor that resembles a standard form such as a Multifaceted Reflector (MR) MR16 or MR11 or a Parabolic Aluminized Reflector (PAR) PAR20, PAR30, PAR38, PAR56 or PAR64.

The reflector can comprise Acrylonitrile Butadiene Styrene (ABS), a polycarbonate, an acrylic or other polymer material and advantageously has a surface metallization to maximize the reflectivity of the reflector. Alternatively the reflector can comprise a thermally conductive material such as aluminum, an aluminum alloy or magnesium alloy.

According to another aspect of the invention an LED spotlight that is operable to emit light with a selected emission angle measured relative to an emission axis of the spotlight comprises: a dish-shaped reflector and a plurality of LEDs each having a respective light emission axis, wherein the LEDs are configured such that in operation each emits light in a radial direction that is substantially orthogonal to the emission axis of the spotlight and wherein the reflector comprises a plurality of generally parabolic light reflective surface portions in which each light reflective surface portion is associated with a respective one of the LEDs. Preferably the LEDs are configured as at least one linear array and lie on a line that is mutually orthogonal to the emission axis of the LEDs and the emission axis of the spotlight. Advantageously the spotlight further comprises a substantially planar thermally conductive substrate and wherein the LEDs are mounted in thermal communication with the substrate to opposite faces of the substrate.

BRIEF DESCRIPTION OF THE DRAWINGS

In order that the present invention is better understood LED spotlights in accordance with embodiments of the invention will now be described, by way of example only, with reference to the accompanying drawings in which.

DETAILED DESCRIPTION OF THE INVENTION

Figure 1:
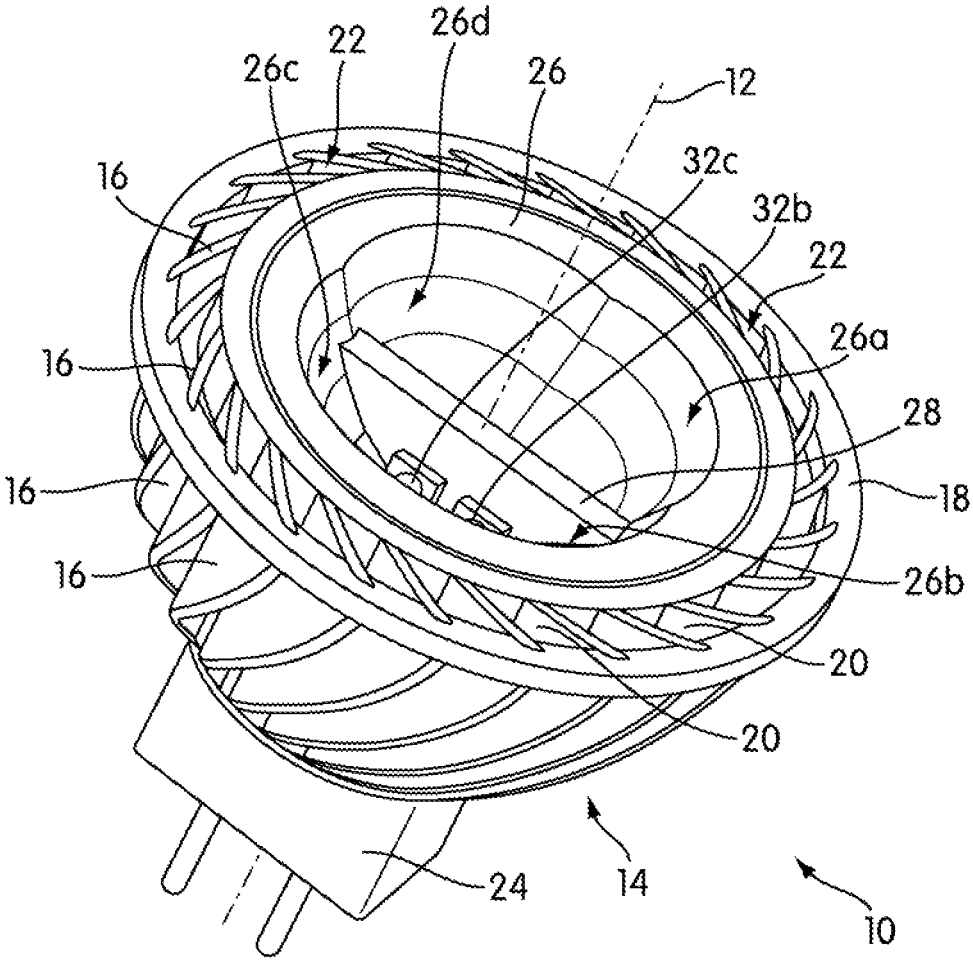
FIG. 1 is a perspective view of an LED spotlight in accordance with an embodiment of the invention.

Embodiments of the invention are directed to LED-based spotlights comprising a dish-shaped reflector typically generally parabolic in form and a plurality of LEDs whose emission axis is configured to extend in a generally radial direction at an angle of at least 40° to the emission axis of the spotlight. In preferred embodiments the LEDs are configured such that their emission axis is substantially orthogonal the emission axis of the spotlight. Configuring the emission axis of the LEDs in such a way, in particular configuring them to be substantially orthogonal to the spotlight's emission axis, enables realization of a spotlight having a compact form factor such as a Multifaceted Reflector MR16 (Ø2" or Ø50 mm) or MR11 (Ø1.5" or Ø40 mm) that still has a narrow emission angle θ (typically less than 20°). To aid in the dissipation of heat the LEDs can be mounted in thermal communication with a thermally conductive substrate. In one arrangement the substrate is substantially planar in form and the LEDs are mounted to opposite faces of the substrate. To enable more LEDs to be incorporated in a spotlight with a compact form factor and thereby produce a greater emission intensity, the LEDs can be configured as a linear array that extends in radial direction. To ensure a uniform emission of light the reflector advantageously comprises a plurality of generally parabolic light reflective surface portions in which each light reflective surface portion is associated with a respective one of the LEDs.

In other embodiments the substrate can be polygonal in form such as triangular, square or rectangular, pentagonal or hexagonal in form and the LEDs mounted to each face of the substrate.

Throughout this patent specification like reference numerals are used to denote like parts.

Figure 2:
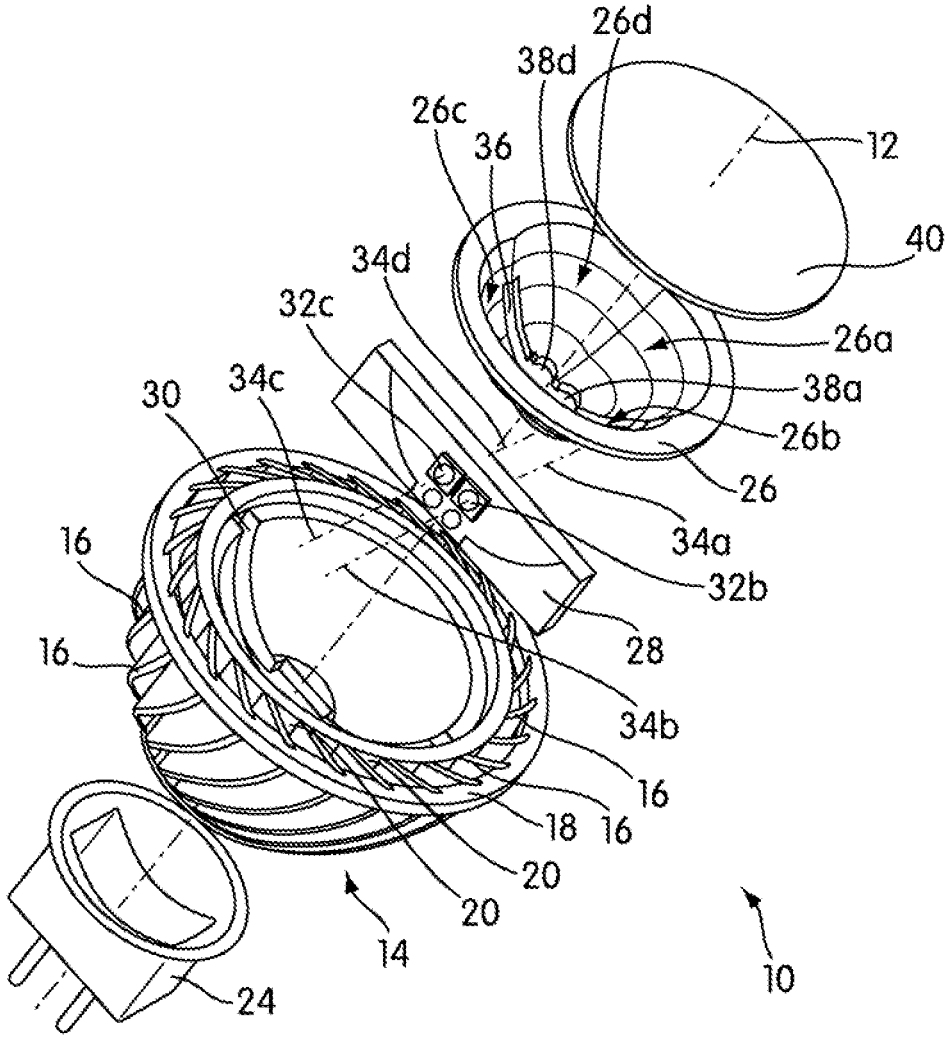
FIG. 2 is an exploded perspective view of the LED spotlight of FIG. 1.
Figure 3:
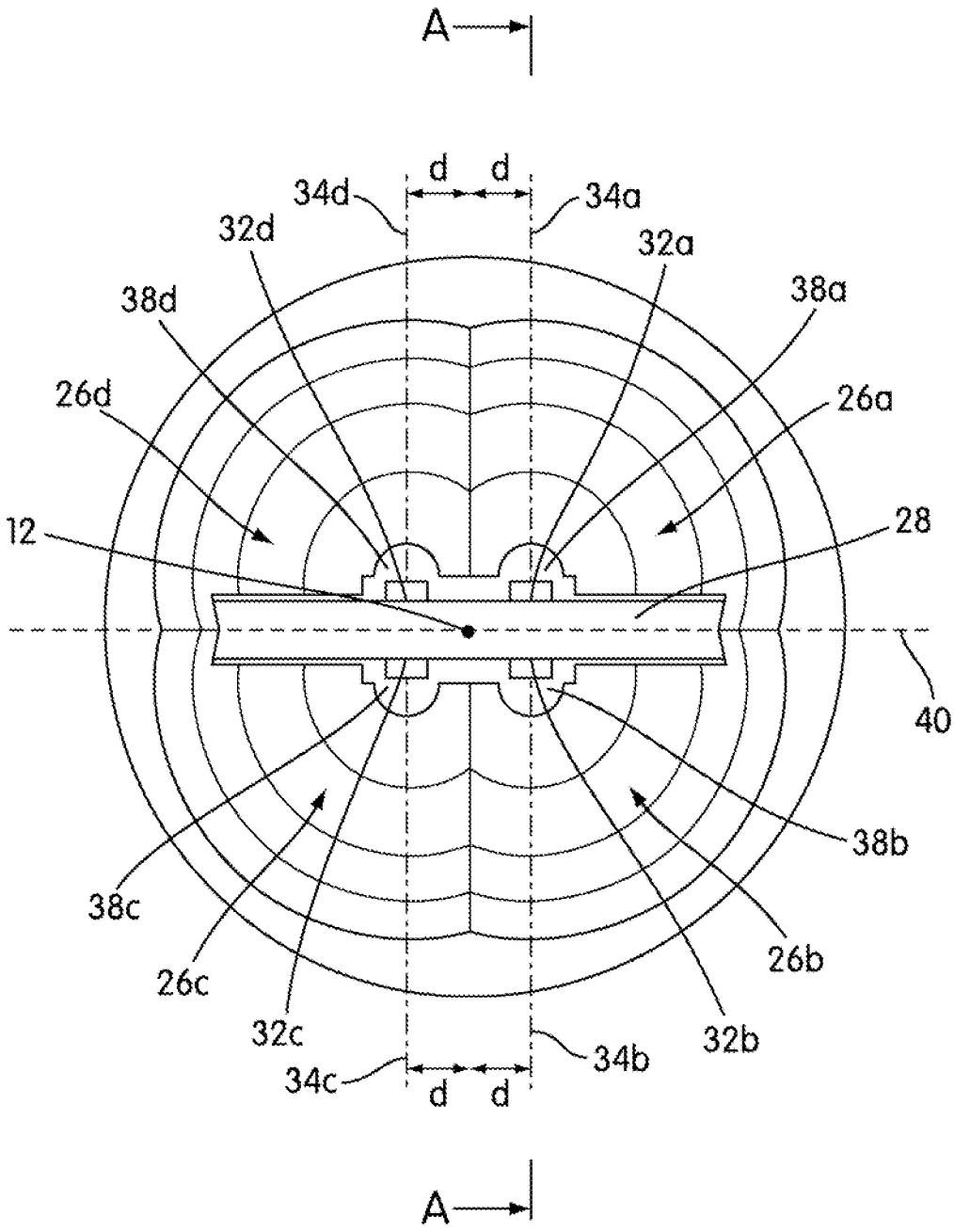
FIG. 3 is an end view of the spotlight of FIG. 1.
Figure 4:
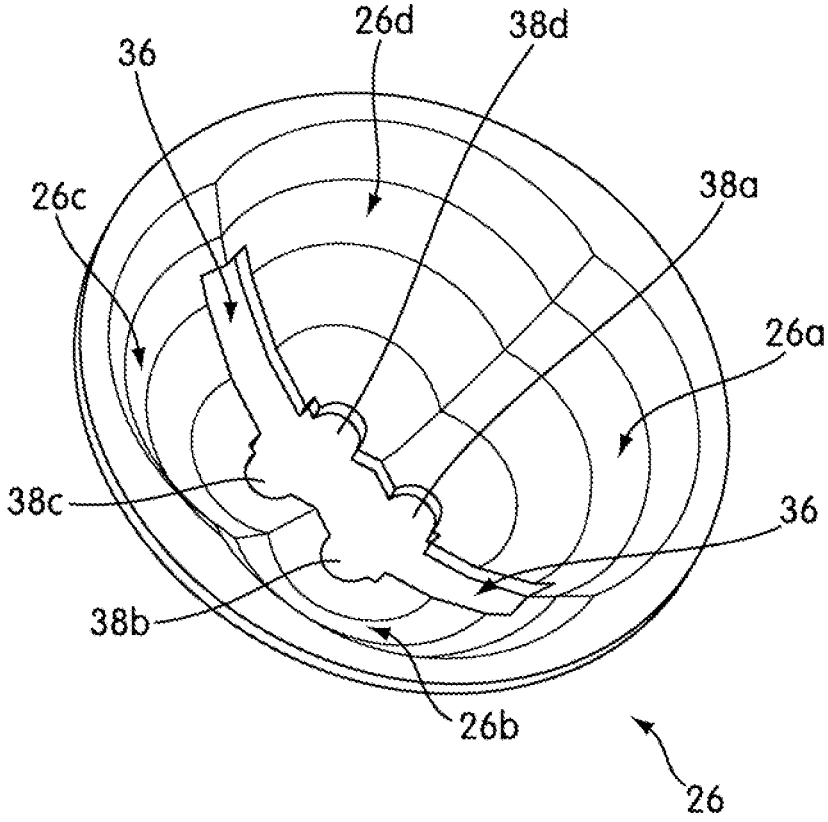
FIG. 4 is a perspective view of a spotlight reflector.

An LED-based spotlight 10 in accordance with a first embodiment of the invention will now be described with reference to FIGS. 1 to 4 in which FIG. 1 is a perspective view of the spotlight, FIG. 2 is an exploded perspective view of the spotlight, FIG. 3 is a end view of the spotlight and FIG. 4 is a perspective view of the spotlight reflector. The spotlight 10 is configured to generate white light with a Correlated Color Temperature (CCT) of ≈3100K, an emission intensity of ≈250 lumens and a nominal (selected) beam spread (emission angle θ–angle of divergence measured from a central axis 12) of 10° (spot). The spotlight typically produces an illuminance of ≈1400 Lux at a distance of 100 cm and it is intended to be used as an energy efficient replacement for an MR16 halogen lamp that is operable from a 12V AC supply.

The spotlight 10 comprises a hollow generally conical shaped thermally conductive body 14 whose outer surface resembles a frustum of a cone; that is, a cone whose apex (vertex) is truncated by a plane that is parallel to the base (i.e. frustoconical). For aesthetic reasons the form factor of the body 14 is configured to resemble a standard MR16 body shape. Configuring the body 14 such that its form factor resembles a standard form additionally enables the lamp 10 to be retrofitted directly in existing lighting fixtures such as spotlight fixtures, track lighting or recessed lighting fixtures. The body 14 is fabricated from die cast aluminum and as shown can comprise latitudinal extending heat radiating fins (veins) 16 that are circumferentially spaced around the outer curved surface of the body 14. As shown the fins 16 extend in a spiral fashion along the length of the frustonical body 14. At the front of the body (that is the base of the cone) the fins 16 in conjunction with an annular rim 18 define a plurality of air inlets 20 configured as an annular array that allows a flow of air 22 (indicated by heavy arrows in FIG. 1) from the front of the body to the rear between the fins to increase cooling of the spotlight.

Alternatively the body can be constructed from an alloy of aluminum, a magnesium alloy, a metal loaded plastics material or a thermally conductive ceramic material such as aluminum silicon carbide (AlSiC). Preferably the body is thermally conductive and has a thermal conductivity of at least 150 $Wm^{-1}K^{-1}$.

The spotlight 10 further comprises a bi-pin connector base 24 GU5.3 or GX5.3 to enable the spotlight to be connected directly to a 12V AC power supply using a standard lighting fixture (not shown). It will be appreciated that depending on the intended application other connector caps can be used such as, for example, bi-pin twist-lock (bayonet) GU10 base or an Edison screw base for 110 and 220V operation. As shown the connector cap 24 can be mounted to the truncated apex of the body 14.

Mounted within the front of the body 14 (that is the base of the cone) the spotlight 10 further comprises a dish-shaped reflector 26 which is configured to define the selected emission angle (beam spread) of the spotlight (i.e. $\theta=10°$). The inner surface of the reflector 26 comprises four elliptical parabaloid quadratic surfaces 26*a*, 26*b*, 26*c*, 26*d* as defined by rotational of an ellipse. As will be further described each parabolic surface is associated with a respective LED. As shown the reflector 26 can comprise a multifaceted reflector though it can also comprise a continuous curved surface. The reflector 26 is preferably fabricated from ABS (Acrylonitrile butadiene styrene) or another polymer material such as a polycarbonate or acrylic with a light reflective surface such as a metallization layer of chromium, aluminum or silver applied to its inner surface. Alternatively the reflector 26 can comprise a material with a good thermal conductivity (i.e. typically at least 150 $Wm^{-1}K^{-1}$ and preferably at least 200 $Wm^{-1}K^{-}$) such as aluminum or an aluminum alloy to aid in the dissipation of heat. To further aid in the dissipation of heat the reflector 26 can be thermally coupled to the body 14.

As is best seen in FIG. 2 a planar thermally conductive substrate 28 is mountable in a radially extending slot 30 within the body 14. The substrate 28 is preferably mounted in thermal communication with the body 14. In one embodiment the substrate 28 comprises a metal core printed circuit board (MCPCB). As is known an MCPCB comprises a layered structure composed of a metal core base, typically aluminum, a thermally conducting/electrically insulating dielectric layer and a copper circuit layer for electrically connecting electrical components in a desired circuit configuration. The metal core base of the MCPCB 28 is mounted in thermal communication with the thermally conductive body 14 with the aid of a thermally conducting compound such as for example an adhesive containing a standard heat sink compound containing beryllium oxide or aluminum nitride. In alternative arrangements the substrate can comprise other materials with a good thermal conductivity that is typically at least 150 $Wm^{-1}K^{-1}$ and preferably at least 200 $Wm^{-1}K^{-1}$ such as an aluminum alloy, copper or an alloy of copper. To further aid in the dissipation of heat the substrate 28 can further incorporate additional cooling devices such as an arrangement of micro loop heat pipes or a thermoelectric cooler based on the Peltier-Seebeck effect.

The spotlight 20 further comprises four 1.1 W LEDs 32*a* to 32*d* in which a respective pair of LEDs 32*a*, 32*b* and 32*c*, 32*d* is mounted to an opposite face of the substrate 28. Driver circuitry for operating the LEDs 32 (not shown) can be mounted to the MCPCB and housed within the body 14 in a cavity below the reflector. Each LED 32 is mounted in good thermal communication with the substrate and can comprise a ceramic packaged 1.1 W gallium nitride-based blue emitting LED chip. The LED chips generate blue light with a peak wavelength in a range 400 nm to 480 nm and typically 455 nm. Since it is generally required to generate white light each LED 32 further includes one or more phosphor (photo luminescent) materials which absorb a proportion of the blue light emitted by the LED chip and emit yellow, green, red light or a combination thereof. The blue light that is not absorbed by the phosphor material(s) combined with light emitted by the phosphor material(s) gives the LED 32 an emission product that appears white in color.

The phosphor material, which is typically in powder form, is mixed with a transparent binder material such as a polymer material (for example a thermally or UV curable silicone or an epoxy material) and the polymer/phosphor mixture applied to the light emitting face of each LED chip. As is known the color and/or CCT of the emission product of the LED is determined by the phosphor material composition, quantity of phosphor material etc. The phosphor material(s) required to generate a desired color or CCT of white light can comprise any phosphor material(s) in a powder form and can comprise an inorganic or organic phosphor such as for example silicate-based phosphor of a general composition $A_3Si(O,D)_5$ or $A_2Si(O,D)_4$ in which Si is silicon, O is oxygen, A comprises strontium (Sr), barium (Ba), magnesium (Mg) or calcium (Ca) and D comprises chlorine (Cl), fluorine (F), nitrogen (N) or sulfur (S). The phosphor material, which is typically in powder form, is mixed with a transparent binder material such as a polymer material (for example a thermally or UV curable silicone or an epoxy material) and the polymer/phosphor mixture applied to the light emitting face of the light guide 32 in the form one or more layers of uniform thickness. The color and/or CCT of the emission product of the spotlight is determined by the phosphor material composition and quantity of phosphor material. The phosphor material(s) required to generate a desired color or CCT of white light can comprise any phosphor material(s) in a powder form and can comprise an inorganic or organic phosphor such as for example silicate-based phosphor of a general composition $A_3Si(O,D)_5$ or $A_2Si(O,D)_4$ in which Si is silicon, O is oxygen, A comprises strontium (Sr), barium (Ba), magnesium (Mg) or calcium (Ca) and D comprises chlorine (Cl), fluorine (F), nitrogen (N) or sulfur (S). Examples of silicate-based phosphors are disclosed in U.S. Pat. No. 7,575,697 "Europium activated silicate-based green phosphor" (assigned to Intematix Corporation), U.S. Pat. No. 7,601,276 "Two phase silicate-based yellow phosphor" (assigned to Intematix Corporation), U.S. Pat. No. 7,655,156 "Silicate-based orange phosphor" (assigned to Intematix Corporation) and U.S. Pat. No. 7,311,858 "Silicate-based yellow-green phosphor" (assigned to Intematix Corporation). The phosphor can also comprise an aluminate-based material such as is taught in U.S. Pat. No. 7,541,728 "Aluminate-based green phosphor" (assigned to Intematix Corporation) and U.S. Pat. No. 7,390,437 "Aluminate-based blue phosphor" (assigned to Intematix Corporation), an aluminum-silicate phosphor as taught in U.S. Pat. No. 7,648,650 "Aluminum-silicate orange-red phosphor" (assigned to Intematix Corporation) or a nitride-based red phosphor material such as is taught in co-pending U.S. patent application Ser. No. 12/632,550 filed Dec. 7, 2009 (Publication No. US2010/0308712). It will be appreciated that the phosphor material is not limited to the examples described herein and can comprise any phosphor material including nitride and/or sulfate phosphor materials, oxy-nitrides and oxy-sulfate phosphors or garnet materials (YAG).

In accordance with the invention each LED 32 is configured such that its emission axis 34*a*, 34*b*, 34*c*, 34*d* is substantially orthogonal to the emission axis 12 of the spotlight. As shown in FIG. 3 each pair of LEDs 32*a*, 32*b* and 32*c*, 36*d* is configured as a linear array with each LED being positioned a same distance d from the emission axis 12 of the spotlight. It will be appreciated that the LEDs are configured as a linear array and lie on a line 40 that is mutually orthogonal to the emission axis of the LEDs 34 and emission axis 12 of the spotlight. Since the emission axis of the LEDs are spaced in a radial direction the reflector 26 comprises four elliptical parabaloidal quadratic light reflective surface portions 26*a*, 26*b*, 26*c*, 26*d* that are configured as quadrants. Each parabolic surface is centered on an associated LED. By configuring the reflector 26 in such a manner the spotlight 10 produces a substantially circular emission of light.

As shown in FIGS. 2 and 4 the reflector 26 further comprises a radially extending through-slot 36 in its base thereby enabling the reflector 26 to be inserted into the body 14 over the substrate 28. The reflector 26 can further include a respective through-aperture 38 extending from the slot 36 to enable the reflector 26 to be inserted over the substrate 28 with the LEDs 32 mounted in place.

Optionally, as indicated in FIG. 2, the spotlight can further comprise a light transmissive front cover (window) 42 which is mounted to the front opening of the reflector 26. For ease of understanding the cover 42 is not shown in FIG. 1. Typically the cover 42 comprises a light transmissive (transparent) window for example a polymer material such as a polycarbonate or acrylic or a glass. It is also envisioned that the cover 42 comprise a lens such as a Fresnel lens thereby enabling the emission angle of the spotlight to be modified by changing the cover. Typically the cover 42 will comprise a light diverging lens though it may also comprise a divergent lens.

Figure 5:
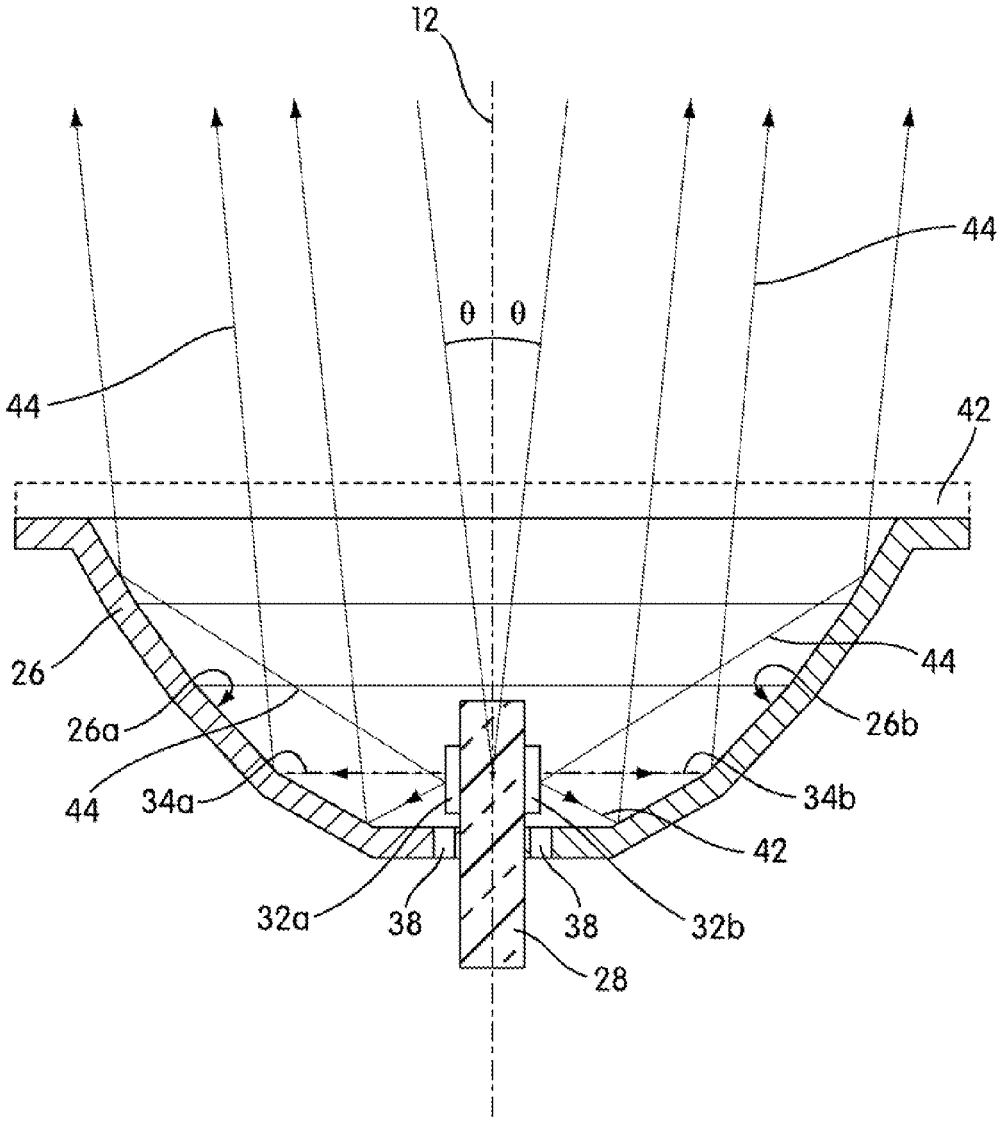
FIG. 5 is a schematic sectional view through a line "A-A" of FIG. 3 illustrating the principle of operation of the spotlight of the invention.

FIG. 5 is a schematic cross sectional view through a line "A-A" of FIG. 3 showing the principle of operation of the spotlight 10 of the invention. For ease of understanding the LEDs 32 are represented in FIG. 5 as a point source though it will be appreciated that in practice each LED may comprise a 1D or 2D array of light emitting elements. Moreover only light rays lying within the plane of the paper are represented in FIG. 5. As can be seen from the figure each of the LEDs 32 is configured such that its axis of emission 34 is orthogonal to the axis of emission 12 of the spotlight. In operation the LEDs 32 emit light 44 in a generally radial direction to the emission axis 12 of the spotlight and this is then reflected by the associated inner parabolic light reflective surface of the reflector 26 such that light emission from the spotlight is substantially confined to the emission angle θ (e.g. 10°). The reflector 26 can be configured such that the full width half maximum (FWHM) emission occurs within the selected emission angle θ. Configuring the emission axis 34 of the LEDs 32 to be substantially orthogonal to the emission axis 12 of the spotlight such that the LEDs emit light in a generally radial direction enables fabrication of a spotlight having a compact form factor and a narrow emission angle. Moreover by configuring the reflector 26 such that each LED has an associated parabolic light reflective surface ensures that the spotlight produces a substantially circular emission product.

Figure 6:
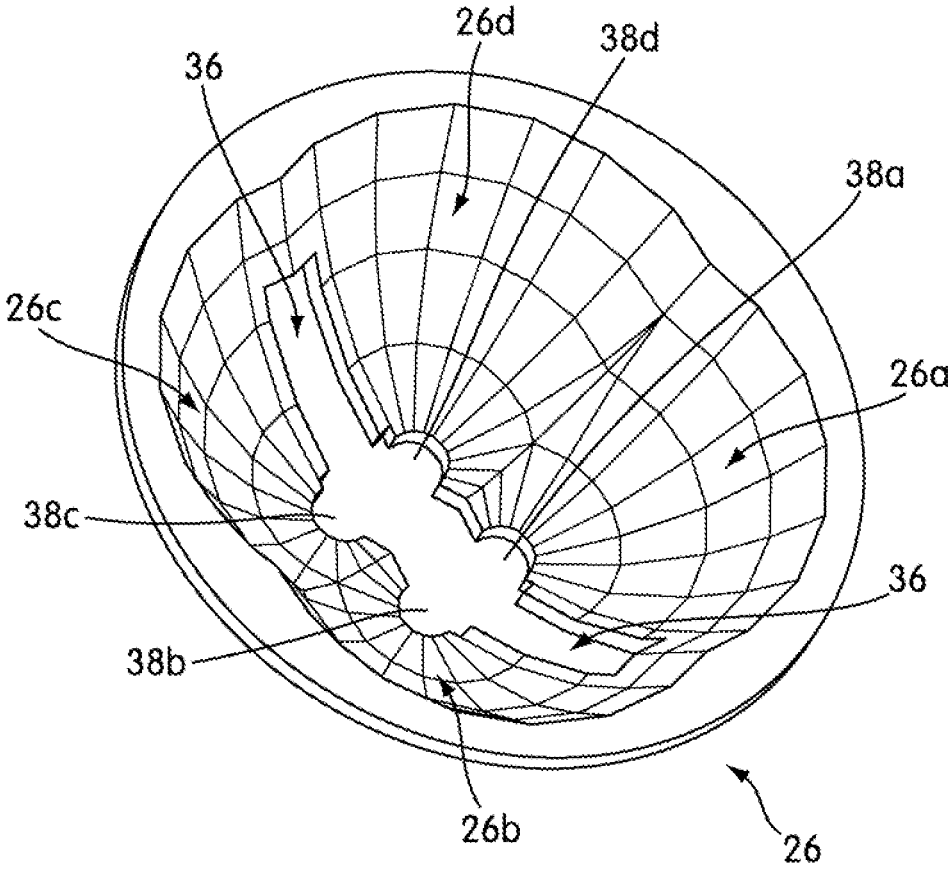
FIG. 6 is a perspective view of a multifaceted spotlight reflector.

FIG. 6 is a perspective representation of an alternative multifaceted reflector 26 for a spotlight of the invention. The reflector 26 has the same form as the reflector of FIG. 4 with the light reflective parabolic surfaces being defined by connecting planar surfaces.

Although the present invention arose in relation to an LED spotlight with a small form factor such as MR16 and MR11 it is envisaged that the invention be applied to other lamps including Parabolic Aluminized Reflector (PAR) lamps such as PAR20 (Ø2.5" or Ø6.5 cm), PAR30 (Ø3.75" or Ø9.5 cm), PAR38 (Ø4.75" or Ø12.2 cm), PAR56 (Ø7" or Ø17.5 cm) and PAR64 (Ø8" or Ø20 cm) lamps.

Figure 7A:
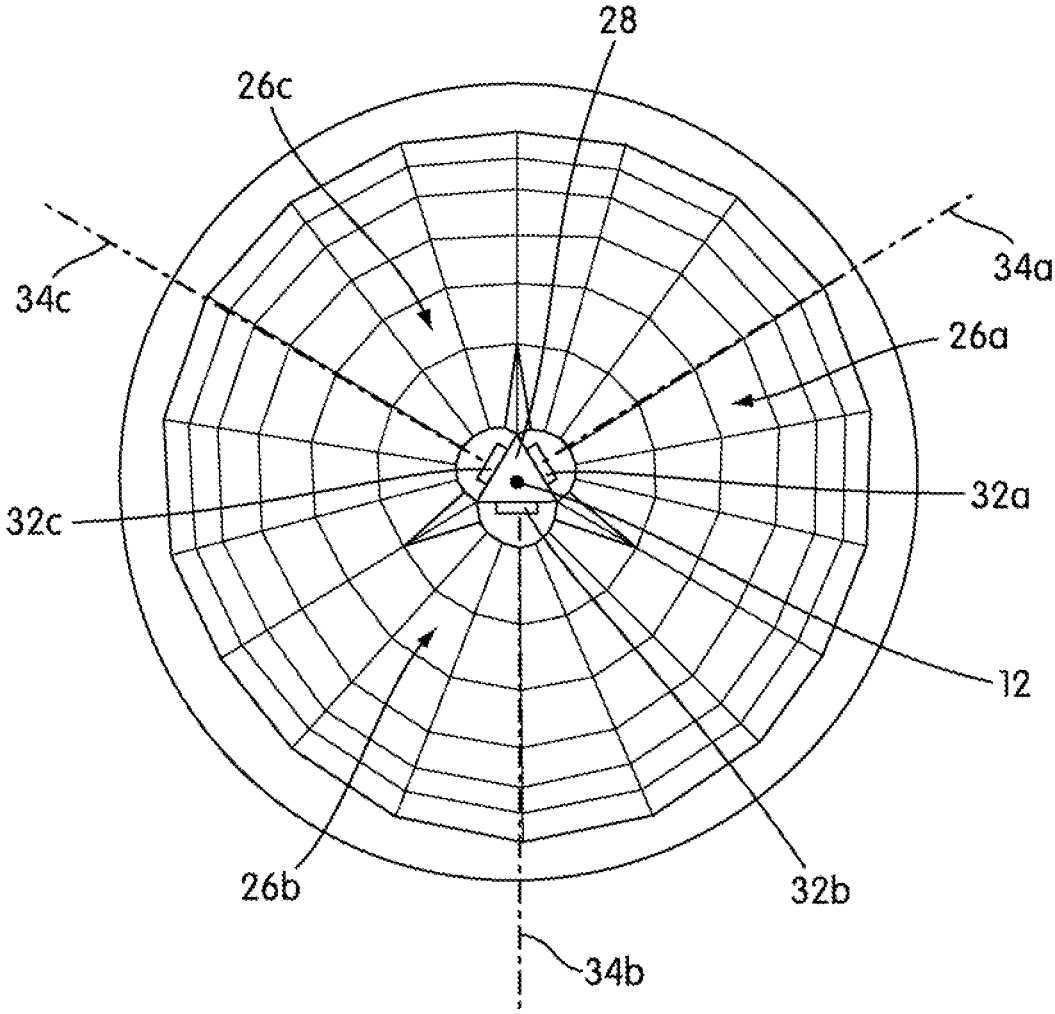
FIGS. 7*a* to 7*c* show schematic plan views of alternative optical configurations for LED spotlights in accordance with the invention.
Figure 7B:
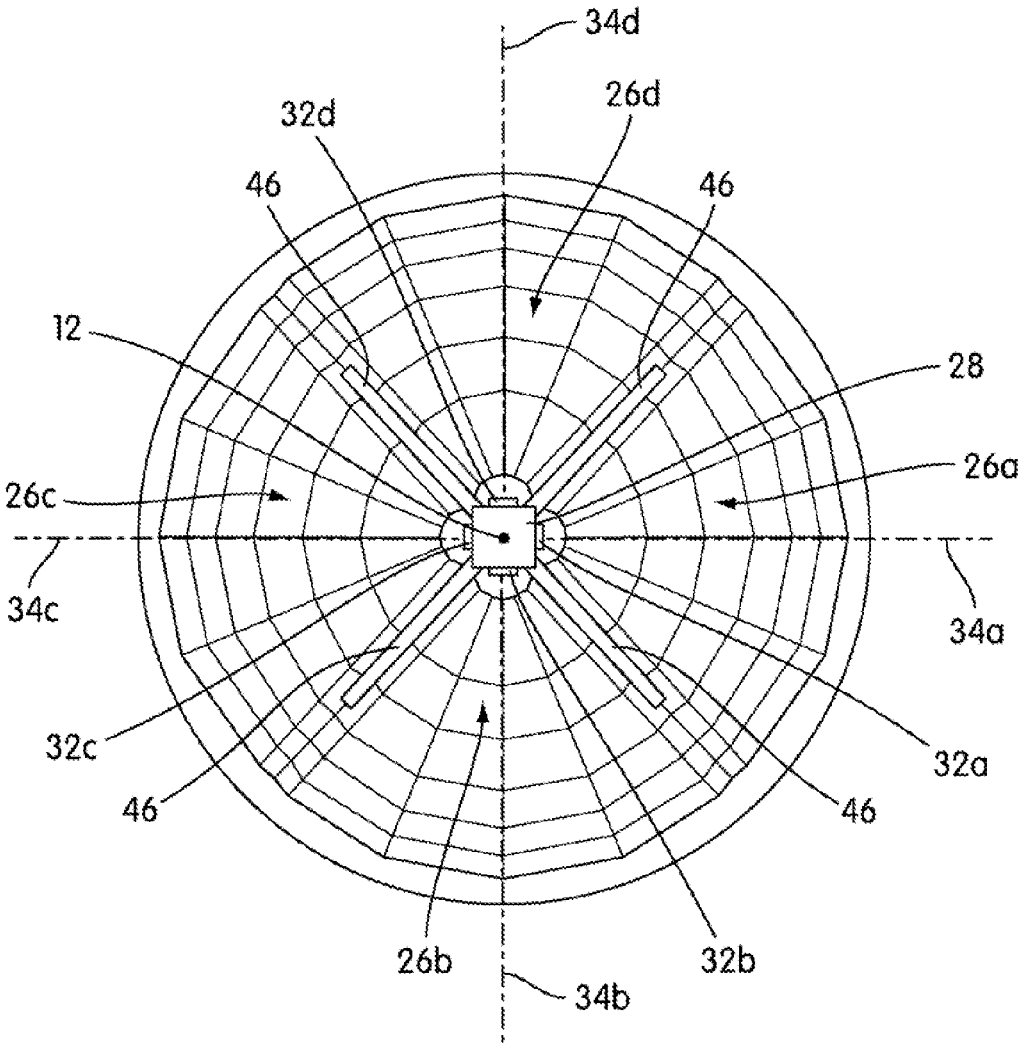
Figure 7C:
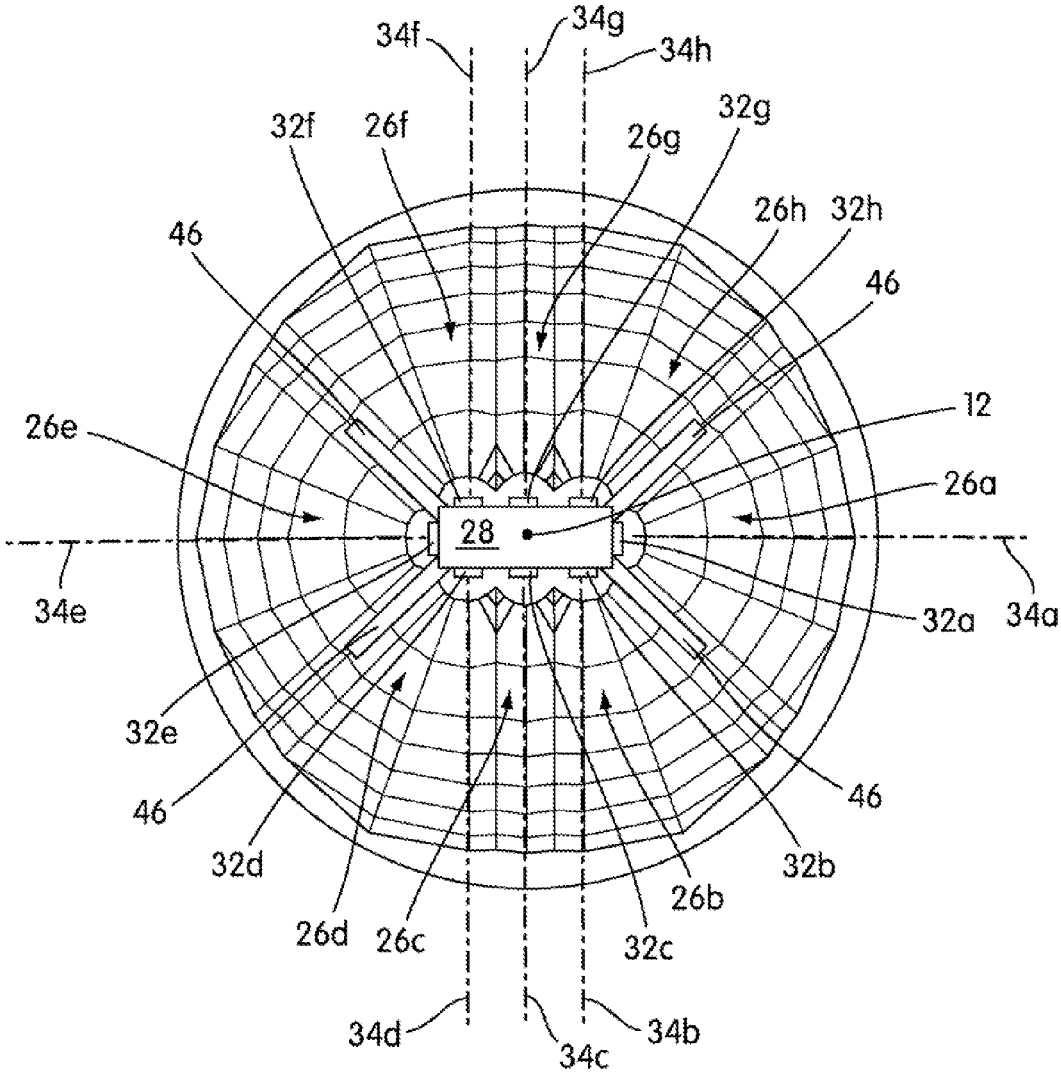

FIGS. 7*a* to 7*c* are schematic end views of alternative optical configurations for LED spotlights in accordance with the invention that are suitable for larger form factor spotlights. In such spotlights the substrate 28 is polygonal in form and one or more LEDs is mounted to a respective face of the substrate. For example in FIG. 7*a* the substrate 28 is, in an axial 12 direction, triangular in form and a respective LED 32*a*, 32*b*, 32*c* is mounted to each face of the substrate 28. In accordance with the invention each LED 32 is configured such that its emission axis 34*a*, 34*b*, 34*c* extends in a radial direction and is substantially orthogonal to the emission axis 12 of the spotlight. The reflector 26 comprises three sectors each comprising a parabolic light reflective surface portion 26*a*, 26*b*, 26*c* in which each surface portion is associated with a respective one of the LEDs. To aid in the dissipation of heat generated by the LEDs the substrate 28 can further a respective rib portion extending in a radial direction from each corner of the substrate. Such a configuration of rib portions increases the thermal mass of the substrate which is particularly important for higher power spotlights.

FIG. 7*b* shows a spotlight in which the substrate 28 is, in an axial direction, square in form and a respective LED 32*a*, 32*b*, 32*c*, 32*d* is mounted to each face of the substrate 28. In accordance with the invention each LED is configured such that its emission axis 34*a*, 34*b*, 34*c*, 34*d* is in a radial direction and is substantially orthogonal to the emission axis 12 of the spotlight. In such a configuration the reflector 26 comprises four quadrant parabolic light reflective surface portions 26*a*, 26*b*, 26*c*, 26*d* in which each surface portion is associated with a respective one of the LEDs. As shown and to aid in the dissipation of heat the substrate 28 can further a respective rib portion 46 that extends in a radial direction from each corner of the substrate.

In FIG. 7*c* the substrate 28 is, in an axial direction, rectangular in form and eight LEDs 32*a* to 32*h* are mounted to the faces of the substrate 28. As illustrated a single LED 32*a*, 32*e* is mounted to each of the shorter end faces and a linear array of three LEDs 32*b* to 32*d* and 32*f* to 32*h* mounted to the longer side faces. Each LED is configured such that its emission axis 34*a* to 34*h* is in a generally radial direction and is substantially orthogonal to the emission axis 12 of the spotlight. In such a configuration the reflector 26 comprises eight sectors comprising a parabolic light reflective surface portion 26*a* to 26*h* in which each surface portion is associated with a respective LED. To aid in the dissipation of heat the substrate 28 can further a respective rib portion 46 that extends in a radial direction from each corner of the substrate. Additionally, though not shown in FIG. 7*c*, the substrate 28 can further comprise a respective rib portion that extends from the face of the substrate in a radial direction from between pairs of LEDs.

Figure 8A:
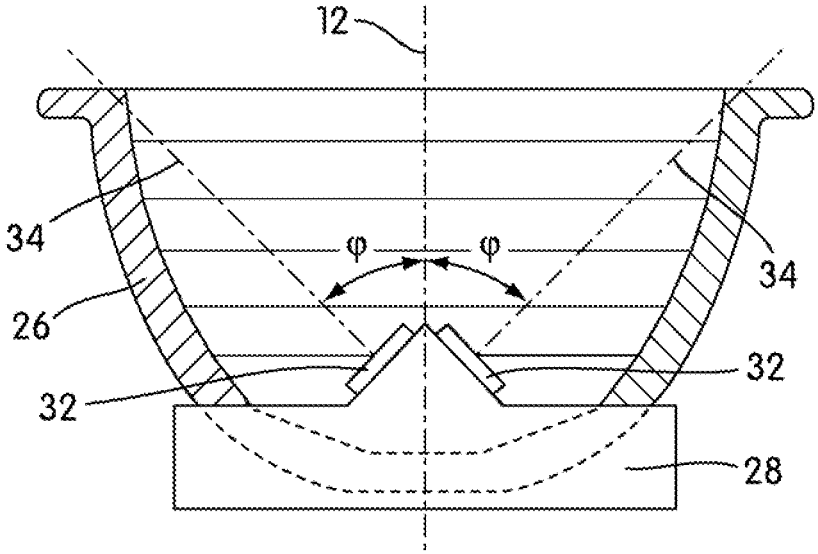
FIGS. 8*a* and 8*b* are schematic sectional views illustrating alternative optical configurations for LED spotlights in accordance with the invention.
Figure 8B:
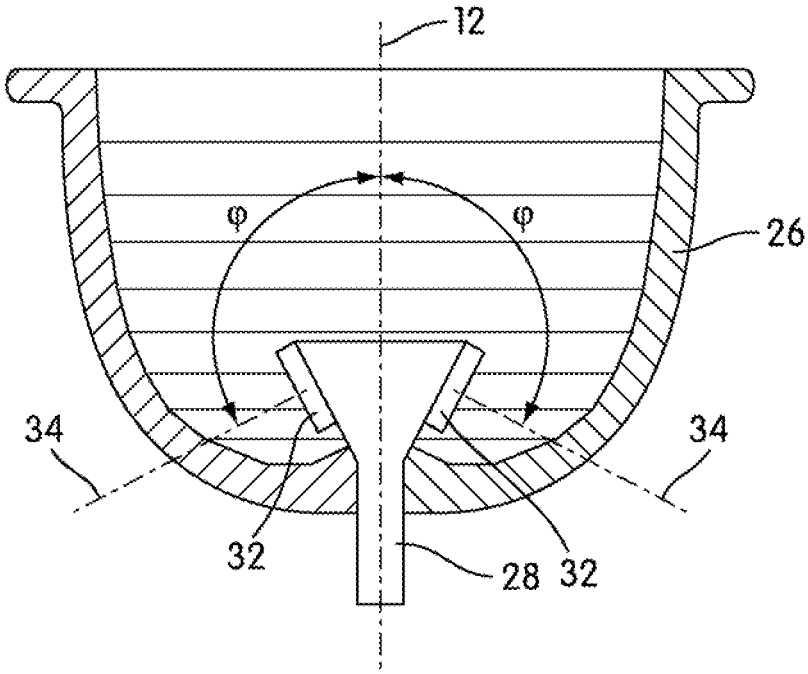

The spotlight of the invention is not restricted to the specific embodiment described and variations can be made that are within the scope of the invention. For example, as shown in FIGS. 8*a* and 8*b*, The LEDs 32 can be configured such that their emission axis 34 extends in a generally radial direction to the emission axis 12 of the spotlight at angles other than 90° to the emission axis 12. In FIG. 8*a* the LEDs 32 are configured such that their emission axis 34 extends in a generally radial direction at an acute angle ϕ to the emission axis 12 of the spotlight. Typically ϕ can be in a range 40° to 85°.

In FIG. 8*b* the LEDs 32 are configured such that their emission axis 34 extends in a generally radial direction at an obtuse angle $\phi$ to the emission axis 12 of the spotlight. Typically $\phi$ can be in a range 95° to 140°.

As well standard forms the body 14 can have a non-standard form factor and be configured such that the lamp can be retrofitted in standard lighting fixtures. Examples of such geometries can include for example a body that is generally cylindrical or generally hemispherical depending on an intended application.

Moreover the inventive concepts can be applied to lamps with other emission angles such as those ranging from a narrow spot ($\theta$=8°) to a wide flood ($\theta$=60°). Typically for down lighting and general lighting applications the emission angle $\theta$ is of order 30°, 45° or 60°.

It will be appreciated that spotlights in accordance with the invention can comprise other LED chips such as silicon carbide (SiC), zinc selenide (ZnSe), indium gallium nitride (InGaN), aluminum nitride (AlN) or aluminum gallium nitride (AlGaN) based LED chips that emit blue or U.V. light.

What is claimed is:

1. An LED spotlight operable to emit light with a selected emission angle measured relative to an emission axis of the spotlight comprising:

a dish-shaped reflector having a plurality of parabolic light reflective surface portions and a plurality of LEDs each having a respective light emission axis, wherein the LEDs are configured such that in operation each emits light in a generally radial direction to the emission axis of the spotlight and wherein the light emission axis of each LED is configured at an angle to the emission axis of the spotlight of at least 40°.

2. The spotlight of claim 1, wherein the LEDs are configured such that their emission axis is at an acute angle to the emission axis of the spotlight at an angle in a range 40° to 85°.

3. The spotlight of claim 1, wherein the LEDs are configured such that their emission axis is at an obtuse angle to the emission axis of the spotlight at an angle in a range 95° to 140°.

4. The spotlight of claim 1, wherein the LEDs are configured such that their emission axis is substantially orthogonal to the emission axis of the spotlight.

5. The spotlight of claim 4, wherein the LEDs are configured as at least one linear array that lies on a line that is mutually orthogonal to the emission axis of the LEDs and the emission axis of the spotlight.

6. The spotlight of claim 1 or claim 5, wherein each of the parabolic light reflective surface portions is associated with a respective one of the LEDs.

7. The spotlight of claim 1, and further comprising a thermally conductive substrate and wherein the LEDs are mounted in thermal communication with the substrate.

8. The spotlight of claim 7, wherein the substrate is substantially planar and the LEDs are mounted to opposite faces of the substrate.

9. The spotlight of claim 8, wherein the LEDs are configured as a linear array that lies on a line that is mutually orthogonal to the emission axis of the LEDs and the emission axis of the spotlight.

10. The spotlight of claim 9, wherein each of the parabolic light reflective surface portions is associated with a respective one of the LEDs.

11. The spotlight of claim 8, wherein the substrate is polygonal and the LEDs are mounted to faces of the substrate.

12. The spotlight of claim 11, wherein the substrate is selected from the group consisting of being: triangular, square, rectangular, pentagonal and hexagonal.

13. The spotlight of claim 11, wherein each of the parabolic light reflective surface portions is associated with a respective one of the LEDs.

14. The spotlight of claim 10, wherein the substrate further comprise rib portions that extend in a radial direction from at least one corner and/or at least one face of the substrate.

15. The spotlight of claim 7, wherein the substrate has a thermal conductivity selected from the group consisting of at least 150 $Wm^{-1}K^{-1}$ and at least 200 $Wm^{-1}K^{-1}$.

16. The spotlight of claim 7, wherein the substrate comprises a material selected from the group consisting of: a metal core printed circuit board, aluminum, an alloy of aluminum, a magnesium alloy, copper and a thermally conductive ceramic material.

17. The spotlight of claim 1, wherein the selected emission angle of the spotlight is 20° or lower.

18. The spotlight of claim 1, wherein the selected emission angle of the spotlight is 10° or lower.

19. The spotlight of claim 1, and further comprising a light diverging light transmissive cover positioned over the reflector opening.

20. The spotlight of claim 7, and further comprising a thermally conductive body and wherein the substrate is in thermal communication with the body.

21. The spotlight of claim 20, wherein the form of the body is selected from the group consisting of being: generally cylindrical, generally conical and generally hemispherical in form.

22. The spotlight of claim 20, wherein the body is configured such that the spotlight can be fitted in an existing lighting fixture.

23. The spotlight of claim 20, wherein the body is configured such that it has a form factor that resembles a standard form selected from the group consisting of: MR16, MR11, PAR20, PAR30, PAR38, PAR56 and PAR64.

24. The spotlight of claim 1, wherein the reflector is selected from the group consisting of: Acrylonitrile Butadiene Styrene, a polycarbonate, an acrylate, polymer material, aluminum, an aluminum alloy and a magnesium alloy.

25. An LED spotlight operable to emit light with a selected emission angle measured relative to an emission axis of the spotlight comprising:

a dish-shaped reflector and a plurality of LEDs each having a respective light emission axis, wherein the LEDs are configured such that in operation each emits light in a radial direction that is substantially orthogonal to the emission axis of the spotlight and wherein the reflector comprises a plurality of generally parabolic light reflective surface portions in which each light reflective surface portion is associated with a respective one of the LEDs.

26. The spotlight of claim 25, wherein the LEDs are configured as at least one linear array that lies on a line that is mutually orthogonal to the emission axis of the LEDs and the emission axis of the spotlight.

27. The spotlight of claim 26, and further comprising a substantially planar thermally conductive substrate and wherein the LEDs are mounted in thermal communication with the substrate to opposite faces of the substrate.

* * * * *